US005158395A

United States Patent [19]

Holmberg

[11] Patent Number: 5,158,395

[45] Date of Patent: Oct. 27, 1992

[54] EROSION CONTROL FOUNDATION MAT AND METHOD

[76] Inventor: Dick L. Holmberg, P.O. Box 100, Whitehall, Mich. 49461

[21] Appl. No.: 351,842

[22] Filed: May 12, 1989

Related U.S. Application Data

[63] Continuation of Ser. No. 945,071, Dec. 22, 1986, Pat. No. 4,889,446, which is a continuation-in-part of Ser. No. 692,211, Jan. 17, 1985, Pat. No. 4,690,585.

[51] Int. Cl.[5] ..... E02B 3/06

[52] U.S. Cl. ..... 405/21; 405/15

[58] Field of Search ..... 405/15-21, 405/23-25, 30-35, 172; 47/9

[56] References Cited

U.S. PATENT DOCUMENTS

| | | | |
|---|---|---|---|
| 247,065 | 9/1881 | Knapp . | |
| 358,195 | 2/1887 | Griswold | 52/3 |
| 644,242 | 2/1900 | Combs . | |
| 716,572 | 12/1902 | Neale . | |
| 752,637 | 2/1904 | Mankedick . | |
| 821,862 | 5/1906 | Depew | 52/3 |
| 867,802 | 10/1907 | Cottrell | 405/21 |
| 984,121 | 2/1911 | Condie . | |
| 1,039,579 | 9/1912 | Neames . | |
| 1,253,209 | 1/1918 | Chenoweth . | |
| 2,570,271 | 10/1951 | Pickett . | |
| 2,662,378 | 12/1953 | Schmitt et al. . | |
| 3,205,619 | 9/1965 | Henry . | |
| 3,226,737 | 1/1966 | Rote . | |
| 3,299,640 | 1/1967 | Nielsen . | |
| 3,311,127 | 11/1885 | Goodridge, Jr. . | |
| 3,315,408 | 4/1967 | Fisher . | |
| 3,344,609 | 10/1967 | Greiser . | |
| 3,396,542 | 8/1968 | Lamberton . | |
| 3,425,227 | 2/1969 | Hillen . | |
| 3,425,228 | 2/1969 | Lamberton . | |
| 3,474,626 | 10/1969 | Colle . | |
| 3,538,711 | 11/1970 | Nielsen . | |
| 3,561,219 | 2/1971 | Nishizawa et al. . | |
| 3,563,037 | 2/1971 | Stammers . | |
| 3,590,585 | 7/1971 | De Winter . | |
| 3,638,430 | 2/1972 | Smith . | |
| 3,670,504 | 6/1972 | Hayes et al. . | |
| 3,696,623 | 10/1972 | Heine et al. . | |
| 3,769,747 | 11/1973 | Chapman, Jr. . | |

(List continued on next page.)

FOREIGN PATENT DOCUMENTS

| | | | |
|---|---|---|---|
| 973373 | 8/1975 | Canada | 405/21 |
| 1942406 | 6/1971 | Fed. Rep. of Germany . | |
| 894675 | 4/1962 | United Kingdom | 405/19 |

OTHER PUBLICATIONS

"Low-Cost Shore Protection", U.S. Army Corps of Engineers, 1981, pp. 728, 729.

Florida Dept. of Natural Resources, Construction Permit #A IR-83, Nov. 16, 1983.

*Primary Examiner*—Randolph A. Reese

*Assistant Examiner*—John A. Ricci

*Attorney, Agent, or Firm*—Price, Heneveld, Cooper, DeWitt & Litton

[57] ABSTRACT

An erosion control structure and method involves placing a large permeable mat with peripheral weighted pockets around and attached to the mat on the bottom of the body of water such that at least a portion of the mat extends to a location where currents have a velocity sufficient to erode the bottom. The peripheral pockets are filled with a weighted material, such as sand. Large weighted stabilizers are placed on the mat and positioned in the areas where the currents exceed the erosion velocity such that the stabilizers are below the surface of the water. The stabilizers are elongated tubular elements filled with a cementitious material, and preferably a large diameter tubular element is secured between two smaller diameter tubular elements. The smaller tubular elements are filled first in order to control the position of the larger diameter tubular element during filling. Further, a crossing tubular element is preferably positioned across a shoreward end of the elongated tubular element in order to form a barrier against wave movement around and past the shoreward end of the elongated tubular stabilizer.

1 Claim, 8 Drawing Sheets

OTHER PUBLICATIONS

| | | | |
|---|---|---|---|
| 3,786,640 | 1/1974 | Turzillo . | |
| 3,807,177 | 4/1974 | Oberg . | |
| 3,862,876 | 1/1975 | Graves . | |
| 3,871,182 | 3/1975 | Estruco . | |
| 3,874,177 | 11/1975 | De Winter . | |
| 3,928,701 | 12/1975 | Roehner . | |
| 3,957,098 | 5/1976 | Hepworth et al. . | |
| 4,080,793 | 3/1978 | Pulsifer . | |
| 4,135,843 | 1/1979 | Umemoto et al. | 405/18 |
| 4,172,680 | 10/1979 | Brown | 405/16 |
| 4,184,788 | 1/1980 | Colle | 405/19 |
| 4,221,500 | 9/1980 | Garrett | 405/24 |
| 4,367,977 | 1/1983 | Shaaf | 405/25 |
| 4,374,629 | 2/1983 | Garrett | 405/24 |
| 4,405,257 | 9/1983 | Nielsen | 405/19 |
| 4,420,275 | 12/1983 | Ruser | 405/217 |
| 4,437,786 | 3/1984 | Morrisroe | 405/24 |
| 4,449,847 | 5/1984 | Scales et al. | 405/19 |
| 4,478,533 | 10/1984 | Garrett | 405/24 |
| 4,668,123 | 5/1987 | Larsen | 405/15 |
| 4,729,691 | 3/1988 | Sample | 405/21 |

EROSION CONTROL FOUNDATION MAT AND METHOD

This is a continuation of application Ser. No. 945,071, filed Dec. 22, 1986, now U.S. Pat. No. 4,889,446, which is a continuation-in-part of application Ser. No. 692,211, filed Jan. 17, 1985, now U.S. Pat. No. 4,690,585.

BACKGROUND OF THE INVENTION

This invention relates to erosion control devices and methods adapted to check shoreline erosion to allow beach material to accrete.

In the United States and other countries, miles of beaches are annually subjected to severe erosion which literally washes away beachfront and exposes higher ground and valuable property to wave action. If left unchecked, wave and current action erodes the property and undermines the foundations of shoreline buildings and houses causing them to topple into the water.

Erosion of this type has been exacerbated and often created by man-made structures. In one typical situation, a pier or jetty is constructed at river mouth and extends perpendicular from the shoreline into the water to form a navigation channel into the mouth of the river. Littoral or near shore currents impinge upon the sides of the pier deflecting the currents away from shore. These currents typically carry sand which would otherwise be deposited near shore between naturally occurring sand bars extending parallel to the shore and the beach. However, since the currents are deflected away from shore, the sand is carried out to deep water, robbing the beach area of sand which would otherwise deposit there.

Furthermore, the deflected currents actually wash away protective sandbars. Sandbars are critical to beach protection since they dissipate waves and littoral currents. When sandbars erode, the beachfront and the area of the eroded sandbar is exposed to much stronger currents and waves, causing even more severe beach erosion. Beachfront property owners often spend tens of thousands of dollars each to construct seawalls or revetments on and parallel to the beach in an attempt to stop such erosion. Such attempts, however, serve only to accelerate erosion. Seawalls and revetments only direct the energy of the waves and currents downwardly to the foundation of the seawall or revetment, which scours sand and rock at the foot of the seawall or revetment structure and which ultimately causes the structure to fall into the water. Such downwardly scouring also deepens the water in the area and allows sediment to be carried away from the littoral zone, leading to even more severe erosion.

An approach typically taken to attempt to stop such erosion is to position piles, groins or other such structures perpendicular to shore. Such structures are invariably constructed so that they extend into the water from the beach and upward several feet above the surface of the water. Again, littoral currents running parallel or at acute angles to the beach deflect from these structures and carry sand seaward. Also, the waves associated with them are reflected downwardly in the immediate vicinity of each of these structures,.eddying and scouring sand and rock on the foot or base of each structure. This eddying eventually undermines the structure and causes it to topple into the water. There have been attempts to reduce the effects of scouring at the bases of the structures by building structures directly in bedrock. However, such construction is extremely expensive as it requires underwater excavation. Such construction is also almost financially prohibitive, especially for the average property owner, in most of the Great Lakes region for bedrock is covered by as much as several hundred feet of unconsolidated clay, sand and gravel.

In addition to the above problems, the increasing weight, height and current velocity in a littoral zone created by these "solutions" leads to other types of erosion and foundation problems. It has recently been observed that the weight of large waves can force water below it into granular, sandy material along the ocean or lake bottom. As water is forced into the granular material, it provides a lubricating water film between the grains and liquifies sandy material below the waves such that currents, if they have sufficient velocity, will wash the liquified material away, or erosion control devices placed on the material will gradually sink into the liquified material. When the devices sink, of course, they lose whatever effectiveness they may have had.

Finally, all of the described devices ruin the aesthetics and desired recreational characteristics of the beach. Because they cause water to deepen and wave energy to increase, these devices create unsightly, scarp-like erosion formations on the beach above the water line. The deeper water and the upwardly projecting structures also pose hazards for swimmers.

SUMMARY OF THE INVENTION

According to the present invention, an elongated tubular structure is extended out from the shore into the body of water. The elongated tubular structure is positioned on a fabric mat that includes anchoring pockets about its perimeter. The elongated tube provides a weighted stabilizer means that has a profile which extends out into the body of water beneath the water surface. In installation, the fabric mat and unfilled fabric which forms the elongated tubular enclosure are positioned to extend out into the body of water. The elongated tubular fabric is then filled with a ballast material, and preferably a cementitious material, in order to pump fill material into the tube from the shore.

In other preferred embodiments of the invention, the elongated tubular stabilizer fabric is formed into a plurality of elongated tubular enclosures that are joined together laterally adjacently. The mat and plurality of elongated tubular enclosures are extended out into the body of water and then filled to form the tubular stabilizers, preferably with cementitious material. Most preferably, the middle elongated tubular enclosure has a diameter substantially larger than that of the adjacent side enclosures. The smaller diameter adjacent side enclosures are filled first in order to form two spaced stabilizing elements that extend out from the shore on the fabric mat. The larger diameter enclosure secured between the side enclosures is then filled while the side elements maintain a larger enclosure in position during filling. Handling and positioning of the larger diameter enclosure is simplified by the previously filled side.

In still another preferred embodiment, another elongated tubular element and foundation mat are positioned across the shoreward end of the elongated tubular element extending into the water. These crossing elements provide a base on shore for the erosion control unit and also deflect and dissipate wave action that occurs from waves moving toward shore and waves which strike and follow the tubular element shoreward.

The cross element therefore protects beach embankment from the beating of waves and also prevents water action from scouring back around behind the shoreward end of the elongated tubular element that extends into the water.

In forming the joint between the elongated tubular elements, the main tubular element extending into the body of water is partially filled, thus leaving a slack region in the vicinity adjacent the crossing tubular element. The crossing tubular element is filled and the main elongated tubular element is then substantially completely filled in order to form a tightly abutting joint against the crossing tubular element.

Preferably, where the currents would otherwise exceed the erosion velocity, the weighted elongated tubular stabilizer is positioned sufficiently far below the surface of the water such that the currents are forced to move upwardly over the stabilizer, thereby reducing the velocity of the currents below the erosion velocity. Furthermore, the elongated tubular stabilizer is positioned such that the waves associated with the currents do not reflect downwardly toward the bottom to scour the bottom.

The permeable mat substantially reduces the capacity of waves to liquify sand or other material beneath the mats as the waves pass over the material. Accordingly, the erosion control structure defined by the mat and the weighted stabilizer will not sink into the liquified, quicksand-like material created by the waves. However, the fabric is sufficiently permeable such that it will allow gases generated, for example, by microbial activity in the sand to percolate upwardly through the structure instead of allowing the structure to be lifted and toppled by the accumulation of such gases.

The provision of the weighted pockets around the mat also prevents the mats from being washed away or lifted by the currents. In fact, it has been found that the weighted pockets will actually orient themselves downwardly into a sandy bottom and be completely covered by sand within a relatively short period of time. Therefore, waves and currents cannot undermine the mat structure.

While installing the erosion control structure, once the fabric elements are positioned extending out into the water the elongated tubular elements can be filled continuously. In many instances such filling can be done from the shore by a pumping of the fill material. This reduces problems associated with filling and positioning individual sandbags or the like. By filling the smaller diameter tubular control elements first, the large diameter elongated tubular enclosure is held in place during filling. The smaller diameter control elements are not as subject to movement due to wave action and are easier to control during the filling process due to their smaller size. Although a large diameter tubular element is subject to movement resulting from wave impact and is much heavier and difficult to control during the filling process, the weighted tubular control elements reduce or prevent such movement.

Because the weighted elongated tubular stabilizer elements are positioned below the surface of the water in areas where currents exceed erosion velocity, the currents and waves will rise over the elongated tubular element instead of reflecting away from or downwardly from the tubular element. As the currents and waves rise over the elongated tubular element, they will dissipate and slow down. They do not cause sand or other material to be carried to deeper water or undermine the erosion control structure. Because the currents can be slowed by the structure, sand will actually deposit between a plurality of such structures positioned parallel to one another, ultimately burying the structures and increasing the beach area.

These and other features, objects and benefits of the invention will be recognized by one skilled in the art from the specification and claims which follow and the drawings appended hereto.

DETAILED DESCRIPTION OF THE PREFERRED EMBODIMENTS

Figure 1:
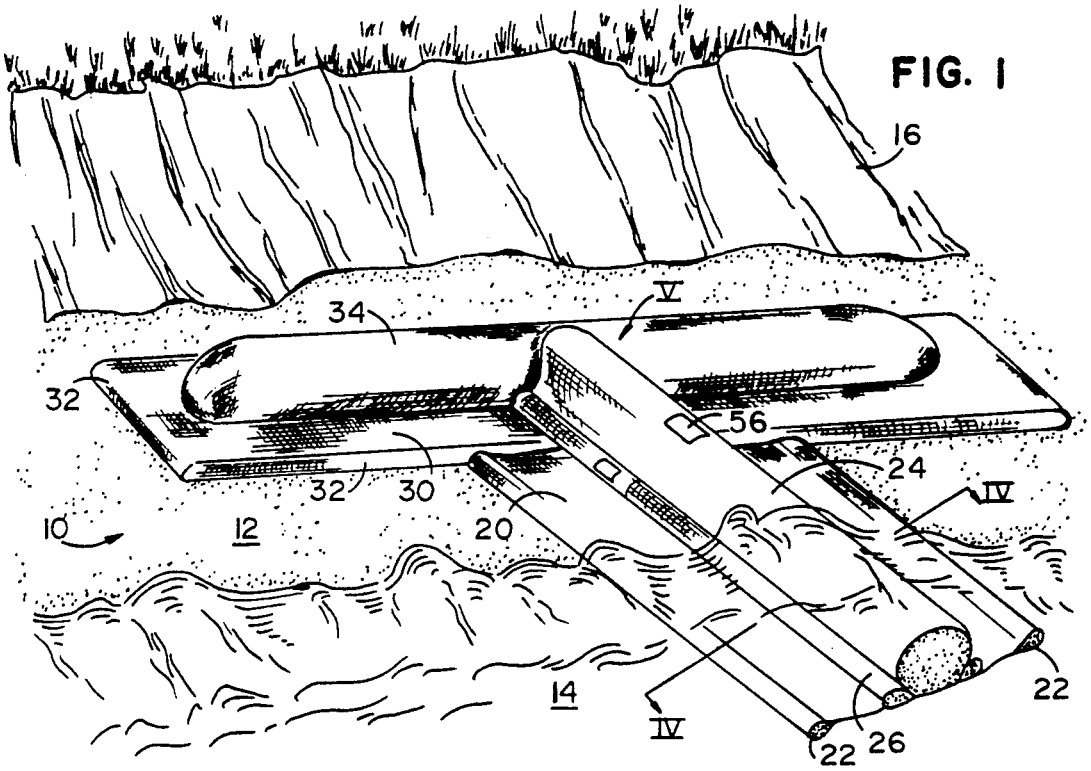
FIG. 1 is a partial perspective view of an erosion control structure of the present invention.

An erosion control device embodying the invention is shown in one preferred form in FIG. 1 and referenced generally by the numeral 10. Erosion control device 10 is placed on a beach 12 to extend perpendicularly from the beach into a body of water 14. Erosion control device 10 extends outwardly into the littoral zone where near shore currents and waves carrying sand are to be dissipated. Erosion device 10 is positioned adjacent an embankment 16 which is also protected by erosion control device 10.

Erosion control device 10 includes an elongated mat 20 of water permeable, geotextile material. An anchoring pocket 22 extends along each elongated edge of mat 20 and is filled with ballast material for burying in the beach and seabed. An elongated tubular stabilizer 24 is positioned on mat 20 in order to extend from beach 12 out into water 14 beneath the water surface. Secured on either side of tubular stabilizer 24 is an elongated tubular control pocket 26. Preferably, in positioning erosion control device 10, control pockets 26 are first filled with ballast material in order to maintain the position of the empty tubular stabilizer 24 while stabilizer 24 is filled. A cross mat 30 is positioned at beach 12 across the shoreward end of elongated mat 20. Cross mat 30 also includes anchor pockets 32. A cross tubular stabilizer 34 crosses the shoreward end of tubular stabilizer 24 and stabilizers 24 and 34 form a tightly abutting joint at their intersection. When a plurality of erosion control structures 10 are placed along the beach extending into water 14 (FIG. 2), the near shore currents in the littoral zone will be dissipated such that sand and other sediment is deposited thereabout instead of eroding sand and sediment away from the beach area. The seaward ends of the erosion control structures extend beneath the water surface so that water passes over the tubular stabilizers 24, dissipating the current and wave energy and causing sand to be deposited. Mats 20 prevent sand beneath tubular stabilizers 24 from liquifying and prevent the sinking of erosion control structures 10 into the sand.

Figure 11:
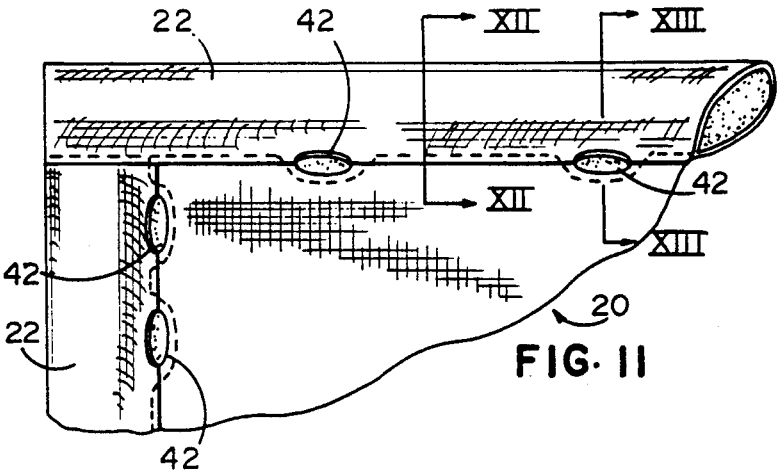
FIG. 11 is a detailed, top elevational view of a corner of the erosion control mat of the present invention.
Figure 12:
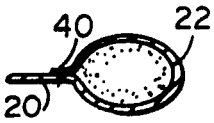
FIG. 12 is a cross section taken along plane XII—XII of FIG. 11.
Figure 13:
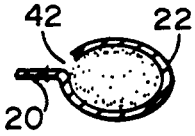
FIG. 13 is a cross section taken along plane XIII—XIII of FIG. 11.

Anchoring pockets 22 extend completely around the periphery of mat 20. Anchoring pockets 22 are constructed by folding over the elongated edges and end edges of mat 20 onto the top surface of the mat and stitching or otherwise securing the hem in place by stitches 40 (FIGS. 11-12). As anchoring pockets 22 are sewn by stitches 40, unstitched openings 42 (FIGS. 11, 13) are left by jogging or varying stitches 40 away from the hem in selected, spaced locations to form a plurality of spaced openings 42 along anchoring pockets 22. Openings 42 are roughly eight to ten feet apart and each opening 42 is about six to eight inches wide. All anchoring pockets 22 are formed by folding the edges of mat 20 toward the same surface of the mat.

When mat 20 is placed on a sandy beach and bottom, openings 42 permit pocket 16 to self fill. For this self filling, mat 20 is laid upon the beach and seabottom with openings 42 on the top surface of mat 20. As sand laden water and wind moves sand around the edges of mat 20, the sand will move into openings 42 and fill anchor pockets 22. In certain circumstances where a more speedy installation is desired, the pockets can be filled by injecting them with a slurry of sand and water. Injecting the pockets is desirable when bad weather is imminent, for example. In other circumstances, anchoring pockets 22 are filled by pumping cement or cementitious material into anchoring pockets 22. When hardened, the cementitious fill or ballast material provides a solid peripheral anchor for mat 20.

It is desirable to have anchor pockets 22 filled with sufficient weighted material such that anchor pockets 22 contain at least about ninety pounds of weighted material per linear foot of anchor pockets 22. To accommodate sufficient material, anchor pockets 22 are preferably approximately twelve inches in diameter when filled with ballast material. A pocket having a twelve inch diameter when filled will provide at least approximately ninety pounds per linear foot of ballast material. These dimensions are for mats ranging from five feet wide by seven feet long to forty feet wide by one thousand feet long. Anchor pockets 22 having a larger diameter when filled may be desirable for mats 20 exceeding dimensions of forty feet by one thousand feet.

Mat 20 is permeable and made of either a woven or alternatively a nonwoven fabric. Geotextile fabrics, such as those sold by Phillips Fibers Corporation under the mark SUPAC are exemplary of acceptable fabrics. The porosity of the fabric should be sufficient that any granular material below the mat will not work its way through the mat. In addition, the porosity should be such that the penetration of water into the sand created by the waves is between three and five percent of the volume of water which would otherwise penetrate the sand if the mats were not there. This substantially prevents the sand underneath the mats from liquifying under the waves as the waves pass over the sand.

Elongated tubular stabilizer 24 is most preferably an elongated cylindrical tube that extends substantially the length of mat 20. Tubular stabilizer 24 is also constructed from a flexible geotextile fabric that is stitched together to form a chamber or enclosure that is open internally along its length but closed at either end. Similarly, control pockets 26 are elongated cylindrical tubes that are constructed from a flexible geotextile fabric and open internally along their length but closed at both ends. Tubular stabilizer 24 has a diameter substantially greater than the diameter of control pockets 26. Although the diameter size of elongated tubular stabilizer 24 may vary greatly depending upon the shoreline and water conditions at which erosion control structure 10 is to be used, preferably elongated tubular stabilizer 24 has a diameter ranging between about three feet to five feet. The diameter of control pockets 26 may also be varied, but preferably the diameter of control pockets 26 ranges between about six inches and one foot.

Figure 4:
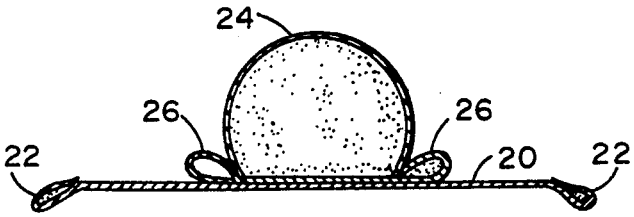
FIG. 4 is a cross section taken along the plane of IV—IV of FIG. 1.
Figure 7:
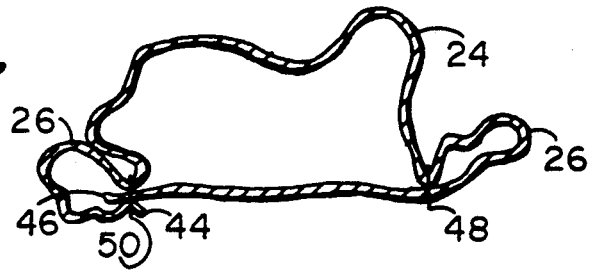
FIG. 7 is a cross-sectional view of the fabric used to form the elongated tubular elements shown in FIG. 4.

As shown in FIG. 4, elongated tubular stabilizer 24 and control pockets 26 are secured together to form a single unit positioned or disposed on mat 20. Preferably tubular stabilizer 24 and control pockets 26 are constructed from a single piece of fabric as shown in FIG. 7. A single sheet of geotextile material having two elongated edges 44 and 46 is folded over into a single tubular shape. A line of stitching 48 joins the upper and lower layers of fabric to form a separation between one control pocket 26 and tubular stabilizer 24. Another line of stitching 50 both forms a separation between the other control pocket 26 and tubular stabilizer 24, as well as joining together edges 44 and 46.

Elongated tubular stabilizer 24 and each control pocket 26 are filled with concrete or sand through fill openings 52 and 54 (FIGS. 9–10) cut through two layered patches 56 and 58 stitched to the upper surface of the tubular element. Provision for filling through fill openings 52 and 54 is made by stitching two square patches 56 and 58 of the same size, one directly above and overlying the other on the upper surface 60 of the tubular element. A line of stitching 62 extends completely around the periphery of the layered patch arrangement, through the two patches 56 and 58 and through the tubular stabilizer fabric forming upper surface 60. Each patch 56 and 58 is about one foot square, although patches 56 and 58 on control pockets 26 may be somewhat smaller.

Figure 9:
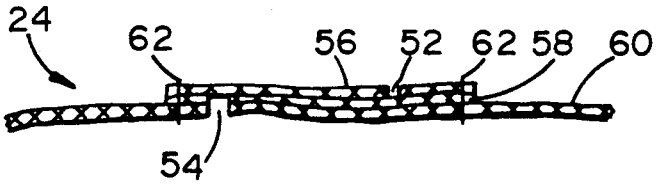
FIG. 9 is a cross section of the fabric element taken along plane IX—IX of FIG. 8.
Figure 10:
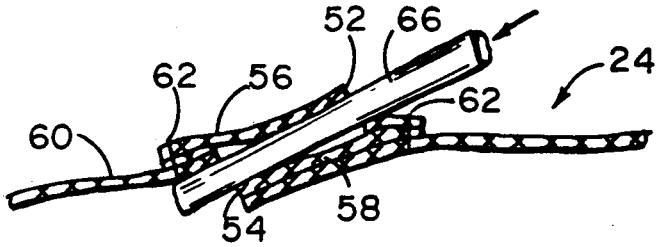
FIG. 10 is a cross section taken along the same plane as FIG. 9, illustrating an injector nozzle inserted into the elongated tubular enclosure.

After tubular stabilizer 24 with attached control pockets 26 are brought to the installation site, fill opening 52 is made by slitting with a knife or other cutting instrument across patch 56 close to and parallel with one course of stitching 62 (FIG. 9). Fill opening 54 is then also slit completely through patch 58 and upper surface 60 of the tubular element. However, fill opening 54 is slit close and parallel with the opposite course of stitching 62. Thus, the two fill openings 52 and 54 are offset from one another so that after the tubular element is filled, the aggregate material in the tubular enclosure cannot work its way out of the tubular enclosure. When the tubular element is filled, the tension on the fabric will force the uncut portion of patch 56 immediately above fill opening 54 to tightly cover fill opening 54, thus preventing fill material from escaping.

Elongated tubular stabilizer 24 and control pockets 26 are preferably filled with a cement or cementitious ballast material. To fill the tubular elements, a pumping unit 64 (FIG. 6) is located on beach 12 at the shoreward end of erosion control device 10. Cementitious material is first pumped into control pockets 26 out from their shoreward end so as to substantially fill the entire length of control pockets 26. With control pockets 26 so filled, the loose fabric forming tubular stabilizer 24 is maintained in position on mat 20 even though substantial wave action may be operating upon the structure. Thereafter, pumping unit 64 is connected to elongated tubular stabilizer 24. To fill tubular stabilizer 24, an injector nozzle 66 (FIG. 10) is inserted through fill opening 52, between patches 56 and 58, and then through fill opening 54 into the interior of tubular stabilizer 24. A cement slurry is then injected into stabilizer 24 through nozzle 66. The water filters out of the tubular enclosure because the tubular enclosure is made of permeable fabric, leaving the cement in the tubular enclosure. The cement within the tubular enclosure will not escape through fill openings 52 and 54 for the reasons explained above.

Figure 2:
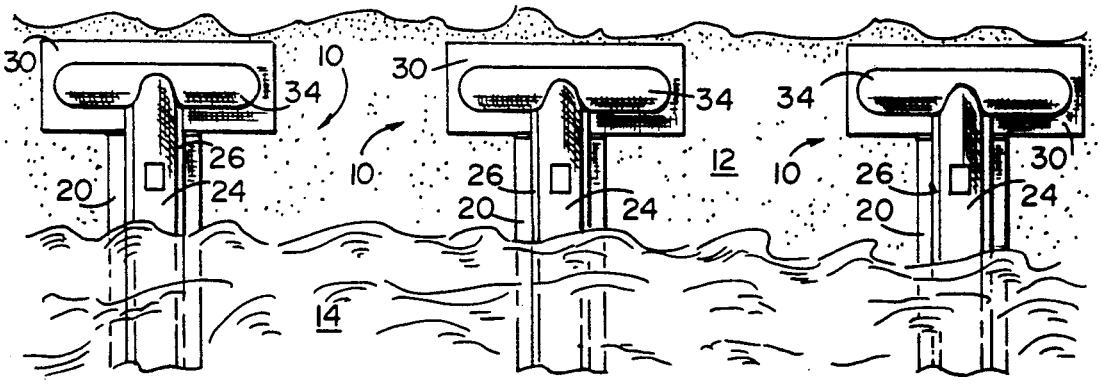
FIG. 2 is a top view of an erosion control system of the present invention.

As is shown in FIGS. 1 and 2, cross mat 30 is placed perpendicular to mat 20 at the beach end of mat 20. Cross mat 30 is provided with anchoring pockets 32 which are similar to anchoring pockets 22. Cross mat 30 is most preferably positioned parallel to beach 12 and at a ninety degree angle with mat 20. However, depending upon the wave and beach conditions mat 20 may extend at an acute angle from cross mat 30. Anchor pockets 32 are filled with ballast material and buried in beach 12 in a fashion similar to that of anchoring pockets 22. Thereafter cross tubular stabilizer 34 is positioned across the top of tubular stabilizer 24 at the beach end of tubular stabilizer 24. Cross tubular stabilizer 34 is a cylindrical enclosure similar to tubular stabilizer 24 and constructed from similar geotextile material. Cross tubular stabilizer 34 has a fill inlet formed in the same fashion as that of patches 56 and 58. However, cross tubular stabilizer 34 is not provided with control pockets similar to control pockets 26. Since cross tubular stabilizer 34 is normally located on the beach during initial installation, waves do not normally strike cross tubular stabilizer 34 during the fill process and therefore such control pockets are not required. Alternatively however cross tubular stabilizer 34 may be provided with control pockets similar to control pockets 26 that maintain the position of cross tubular stabilizer 34 during filling.

During the filling of tubular stabilizer 24 the ballast of fill material is pumped out from the shoreward end of stabilizer 24 out into the body of water to the submerged end of stabilizer 24. Although preferably only a single fill inlet is required, alternatively a plurality of fill inlets may be spaced along the length of elongated tubular stabilizer 24. If a kink or blockage develops in tubular stabilizer 24, a fill inlet located on the other side of the kink may be utilized for filling tubular stabilizer 24. Similarly, relatively long erosion control devices 10 may require additional fill inlets along the length of tubular stabilizer 24 and control pockets 26 in order to pump fill material all the way out to the end of device 10.

Figure 6:
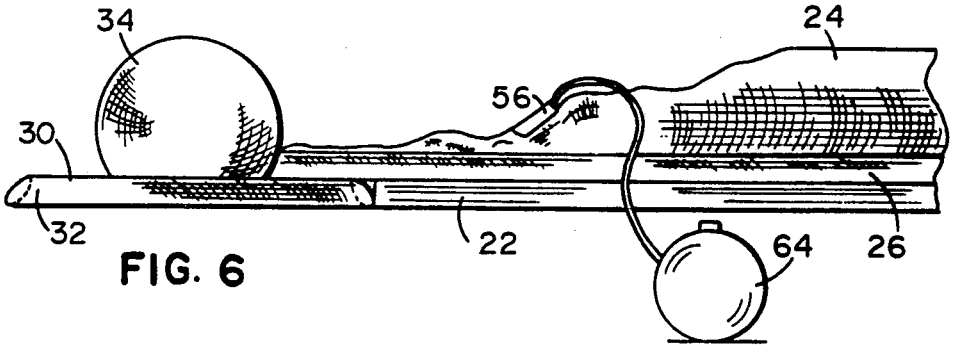
FIG. 6 is a fragmentary, side profile of the erosion control system of FIG. 5 shown during the filling operation.

Most preferably, control pockets 26 are first filled with cementitious material from the shoreward end of control pockets 26. Thereafter the cement pumping unit 64 is connected to tubular stabilizer 24 and the filled nozzle directed out toward the body of water. Cement is pumped into tubular stabilizer 24 in order to fill the submerged end of tubular stabilizer 24. Tubular stabilizer 24 is not completely filled so that the shoreward end of the fabric slumps toward cross tubular stabilizer 34 (FIG. 6). Cross tubular stabilizer 34 is substantially filled with cement. Finally, pump unit 64 is used to substantially completely fill tubular stabilizer 24 so that tubular stabilizer 24 tightly abuts with cross tubular stabilizer 34. This forms a tightly abutting joint between the two elements, giving erosion control structure 10 an overall "T" configuration. With this configuration, waves that move along or follow tubular stabilizer 24 will eventually strike cross tubular stabilizer 34 prior to impacting on any embankment behind or landward of erosion control structure 10. Cross tubular stabilizer 34 also prevents wave action from scouring or eroding back behind the shoreward end of tubular stabilizer 24 as well as providing the breakwall effect.

Tubular stabilizer 24 and mat 20 should be placed to extend to locations where currents exceed the sand entrainment or erosion velocity, with at least the seaward end of tubular stabilizer 24 positioned sufficiently below the surface of the water such that the waves and currents can go over tubular stabilizer 24. As indicated above, it is believed that currents deflecting from the structure cause the sand-laden currents to be directed away from shore into deeper water where the sand deposits instead of depositing in near shore areas and building beaches.

Figure 3:
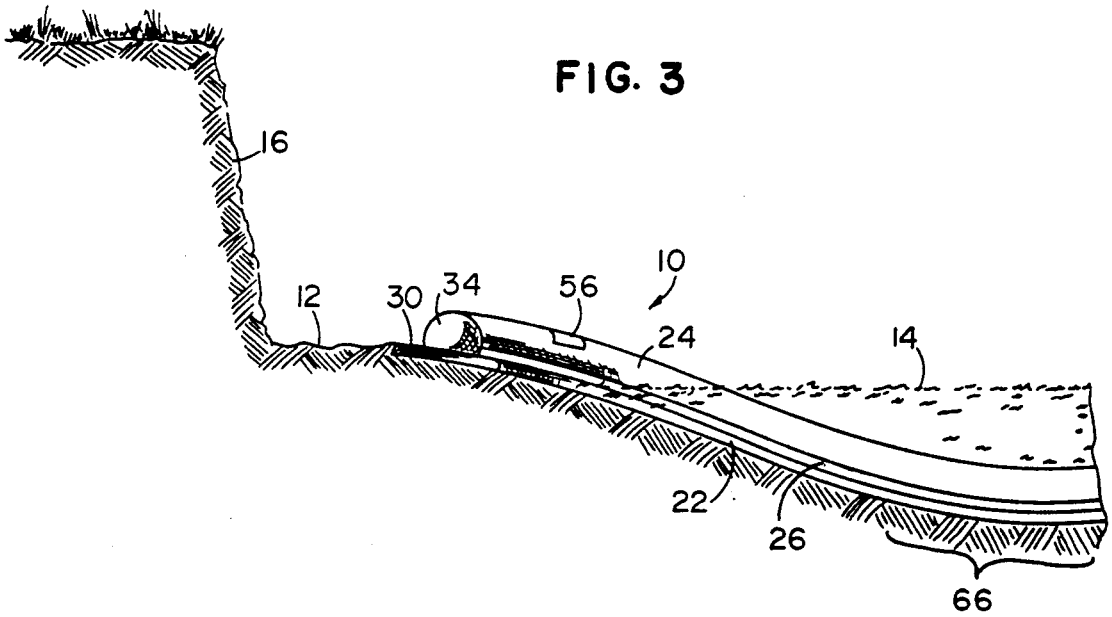
FIG. 3 is a side profile of the erosion control system of FIG. 1.
Figure 5:
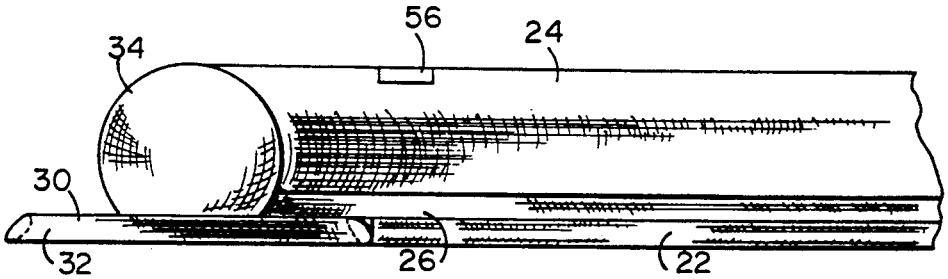
FIG. 5 is a fragmentary, side profile of the erosion control system taken in the region of arrow V in FIG. 1.

As shown in FIG. 3, for example, a deep end portion 66 of each erosion control structure 10 is positioned below the water surface where the littoral zone currents running parallel or at an acute angle to shore previously exceeded the erosion velocity. Because deep end portion 66 remains below the surface of the water, the littoral currents and waves will be urged gently upwardly over the structure such that their kinetic energy will be dissipated. This lowers the velocity of the currents such that sand will deposit, not erode. Again, the deep end portion 66 should remain sufficiently far below the water surface in the erosion current zone such that the currents will be gently forced upwardly and not deflected away or downwardly from the structure.

As shown in FIG. 3, portions of structure 10 projects above the surface of the water. Placing a portion of the erosion control structure above the main waterline 14 serves to retard erosion in periods of high tide. In high tide periods, a greater portion of the length of each erosion control structure 10 is below the surface of the water where eroding currents can be dissipated.

Even in inland lakes, such as the Great Lakes, where tides do not occur, placing a portion of the length of each erosion control structure 10 on the beach serves to catch and accumulate sand in stormy periods. When storms arise, the waves carry sand captured at the toe or deep water end of the erosion control structure (see FIG. 4) to the head or shoreward end of the structure on the beach, depositing sand on the beach. Cross tubular stabilizer 34 acts to accumulate sand on the beach itself as well as to reduce the beating of waves against the embankment 16. The portion of the structure 10 on the beach, therefore, functions to prevent sand from being washed back into the lake.

Figure 14:
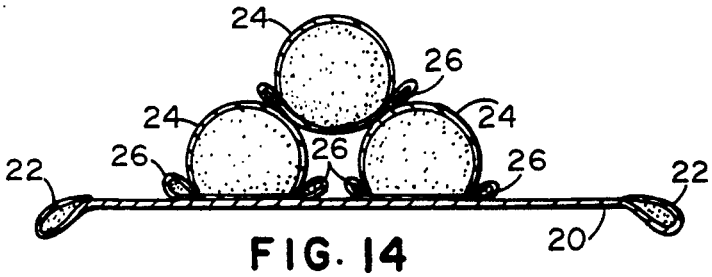
FIG. 14 is a cross-sectional view of an alternative erosion control system showing stacked elongated tubular elements.

Alternatively, as shown in FIG. 14, several tubular stabilizers 24 may be stacked on a single mat 20, with two parallel tubular stabilizers placed directly on mat 20 and a third stabilizer stacked on top. In some circumstances, three or more rows may be placed in a pyramid fashion on mat 20 in order to produce a structure of sufficient height. The idea is to have the structures project upwardly from the bottom of the ocean or lake bottom a sufficient distance such that they slow the waves and currents, not deflect them.

In many instances, it is necessary to place a plurality of erosion control structures 10 comprising the foundation mat 20 and tubular stabilizer 24 parallel to and spacedly positioned from one another perpendicular to the shoreline as shown in FIG. 2. Often, the deep end portion 66 of one structure 10 will not sufficiently dissipate currents. However, three or more such structures will reduce the current velocity because the cumulative effect of each of the structures forces the currents gently upwardly and reduces the current velocity below the erosion velocity. When this happens, the currents no longer entrain sand, they deposit it, allowing the beaches protected by the devices to accrete.

Once enough material has deposited along and between the first series of parallel structures 10, structures 10 will actually become almost completely buried in sand. At this point, additional structures can be installed along the new shoreline, as will be described below.

Figure 20:
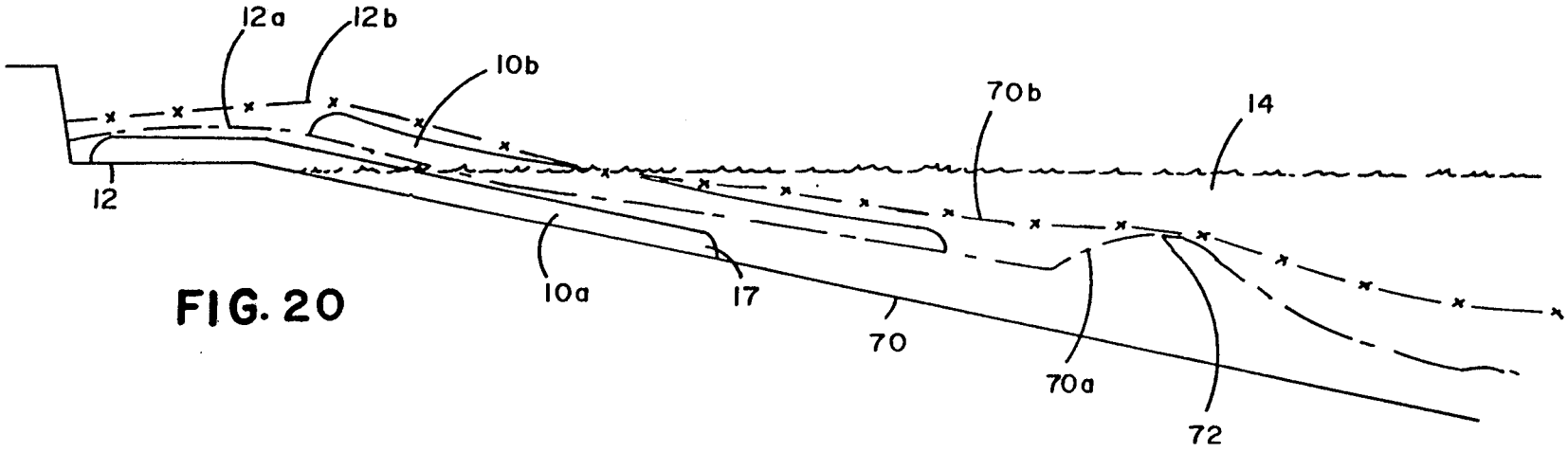
FIG. 20 is a side profile view illustrating the placement of a series of erosion control structures over time as beach material accretes.

As shown in FIG. 20, for instance, a first erosion control structure **10*a* of a series of such parallel structures is placed on the original bottom 70 of the lake with a toe end 17 of the structure at a depth and a distance into the lake or water body 14 where it performs the current dissipating function described above. Over a matter of months, in most instances, sand accumulates around and between the parallel erosion control structures 10*a* and forms a new bottom 70*a*. Often, a protective sandbar structure 72 forms parallel to shore at a distance from toe end 17. It is believed that sandbar structures 72 form as a direct result of the current dissipating characteristics of the structures 10*a* described above. Furthermore, sandbars 72 tend to be quite stable since currents are not deflected and waves are not deflected away from structures 10*a*** toward deeper water.

Over time, therefore, new bottom **70*a* will eventually cover the original structure 10*a* and form a new beach 12*a* above structures 10*a*. Raising the beach to a new level 12*a* (FIG. 20) actually forces the old shoreline to retreat outwardly from the old beach 12** to a new shoreline which can be as much a thirty to sixty feet from the old shoreline.

If sandbars 72 form, it is often not necessary to do anything else to restore the beach since the sandbags serve as a natural protection of the beach. However, additional beach can be added if sandbars 72 do not form or if they do form but even more beach is desired, by placing a second series of parallel structures **10*b* on the new bottom 70*a*. The second set of structures 10*b* raise the bottom to a second level 70*b*, and raise the beach even higher to a third level 12*b***. Similarly, the shoreline retreats to a third position further out into the water body than the second waterline.

Each of the second structures **10*b* do not have to be placed directly on top of a first structure 10*a*. Instead, each second structure 10*b* can be staggered intermediate two first parallel structures 10*a*. Furthermore, second structures 10*b* do not need to be the same length as first structures 10*a*. Depending upon where the high velocity erosion currents are located after the first structures cause the first bottom 70*a* to form, the second structures 10*b*** should be positioned to extend outwardly from the beach to dissipate those currents and to reduce their velocities such that sand will deposit, not erode.

A third series of structures (not shown) can be placed above and beyond the second structures **10*b*** shown if it is desired to extend the beach even further.

Figure 21:
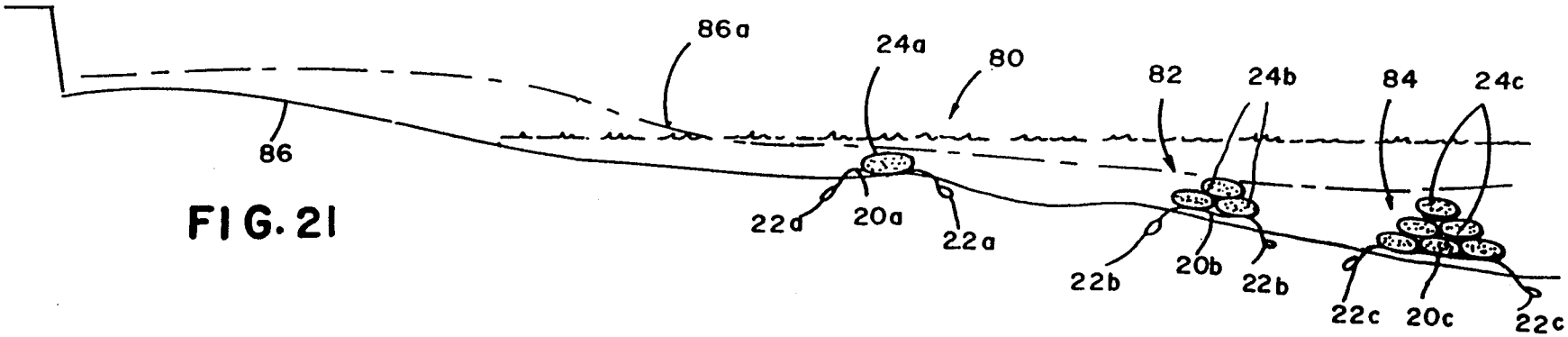
FIG. 21 is a side profile view in section of an alternative method of employing erosion control structures of the present invention.

As shown in FIG. 21, three parallel artificial sandbars 80, 82 and 84 are placed parallel to the shoreline. Artificial sandbars are installed parallel to shore where long seawalls or other elongated structures have created a long stretch of deep water near shore. If the water is still shallow near shore, the structures are placed perpendicular to shore, as illustrated in FIGS. 1, 2 and 3. As shown in FIG. 21, first artificial sandbar 80 is constructed parallel to shore by placing on the lake or ocean bottom parallel to shore a first elongated mat **20*a* with peripheral weighted pockets 22*a* extending completely around the mat 20*a* having spaced openings 42*a*. A single elongated tubular stabilizer 24*a* is then placed along the length of the mat 20*a*. Mat 20*a* and stabilizer 24*a* are positioned parallel to shore in a depth of water such that stabilizer 24*a* dissipates currents running at acute angles with respect to the shoreline. Again, first sandbar 80 is placed at a position where the velocity of the water is sufficient to entrain sand or other debris at the bottom of the water body. However, it does not break through the water surface so as to deflect the currents or waves toward deeper water. Instead, the currents will be dissipated by being forced to move gently over the first sandbar 80**.

A second artificial sandbar 82 can be placed parallel to the first sandbar 80 in even deeper water than the first. Artificial sandbar 82 also has an elongated mat **20*b* with peripheral pockets 22*b* filled with sand or other weighted material holding the mat against the bottom of the water body. In second sandbar 82, three stacked tubular stabilizers 24*b* are placed in a pyramid configuration on mat 20*b* (FIGS. 14, 21). Again, second artificial sandbar 82** is positioned such that it dissipates rather than deflects the currents and waves.

A third artificial sandbar 84 can be positioned outwardly from and parallel to the first two artificial sandbars in even deeper water to dissipate currents further from shore. Again, third sandbar 84 is constructed from a base mat 20c with peripheral pockets 22c filled with a weighted material. A pyramid of five rows of elongated tubular stabilizers 24c is positioned atop and along the length of mat 20c.

Parallel artificial sandbars raise the original bottom 86 to a level such that it covers the three artificial sandbars at a new elevation 86a. Again, wave action will force a certain amount of additional sand on the beach such that the original shoreline retreats seawardly to a new position as sand accretes due to the current and wave dissipation of the three artificial sandbars.

The artificial sandbars 80, 82 and 84 should be placed such that the tops of the artificial sandbars are located at a level approximately where the new seabottom 86a is to be located. Furthermore, the artificial sandbars should be placed sufficiently far apart that waves passing over one artificial sandbar will not break against the next artificial sandbar but instead will substantially dissipate between the two. Waves should break between the artificial sandbars.

The number of stabilizers in the pyramids of sandbars 80, 82 and 84 is not critical. As indicated above, the object is to make the tops of the bars extend to a level where the new seabottom is to be located. In some circumstances, therefore, a five row pyramid may be unnecessary because the bottom may not have to be raised that far.

No matter whether the structures are oriented perpendicular to or parallel to the shoreline, the base mats with the peripheral weighted pockets will insure that the mats will not get washed away and will prevent sandy, granular material underneath them from liquifying or becoming the consistency of quicksand where the structures could sink into the bottom.

Figure 15:
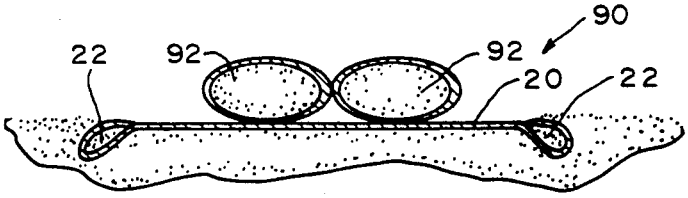
FIG. 15 is a cross section of a second alternative embodiment of the invention showing two laterally adjacent elongated tubular elements.
Figure 16:
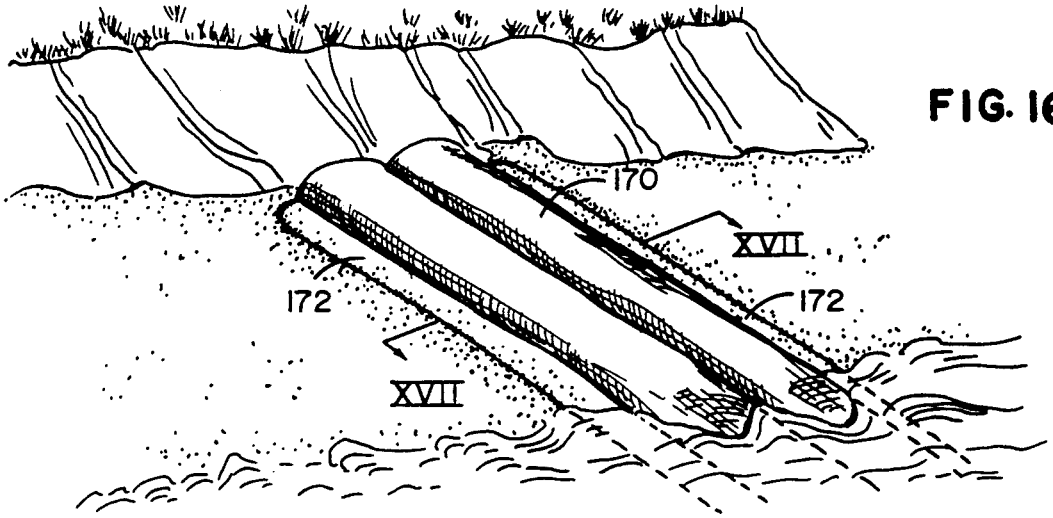
FIG. 16 is a partial perspective view of a third alternative erosion control device of the present invention.
Figure 17:
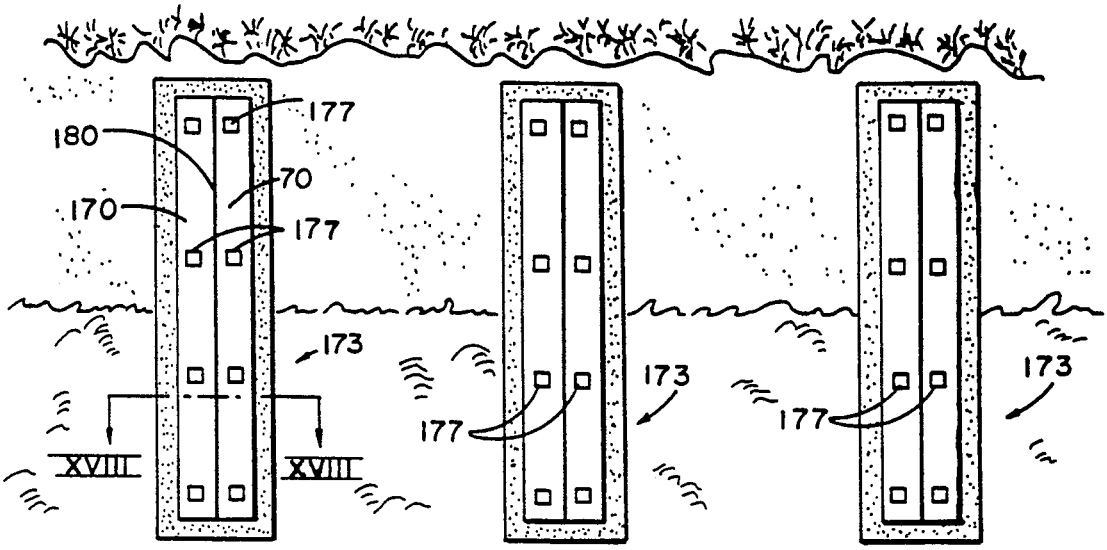
FIG. 17 is a top elevational view of an alternative erosion control system making use of the alternative erosion control device of FIG. 16.

An alternative structure 90 is shown in FIG. 15 having a plurality of side-by-side or adjacent tubular stabilizers 92 that are placed on a single mat 20.

Figure 18:
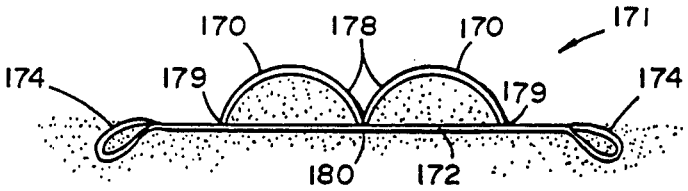
FIG. 18 is a cross section taken along plane XVIII—XVIII of FIG. 16.
Figure 19:
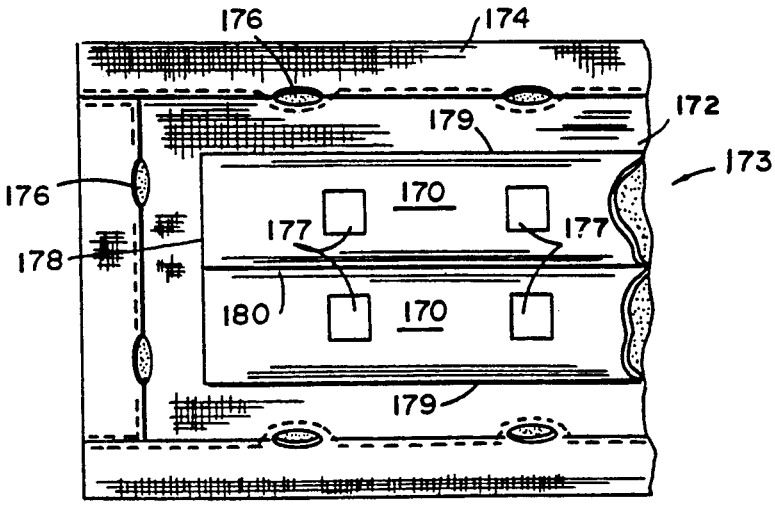
FIG. 19 is a detailed, top elevation of the erosion control structure of FIGS. 16 and 17.

Another alternative preferred embodiment is shown in FIGS. 16–19. As shown in FIG. 18, two parallel central pockets 170 are sewn directly onto the center part of a permeable mat 172 with peripheral pockets 174 extending completely around the edges of mat 172. Mat 172 is identical in construction to the mat 20 described above including the provision of spaced openings 176 in peripheral pockets 174 created by leaving unstitched portions in the hems which form peripheral pockets 174.

The two central pockets 170 are formed by laying an upper sheet of permeable fabric 178 along the center of mat 172, stitching the edges of upper sheet 178 directly to the upper surface of mat 172 and then stitching the middle of upper sheet 178 to the middle of mat 172 by running a middle stitch 180 between and parallel to the stitches 179 along the elongated side edges of upper sheet 178.

The concrete or sand is injected in a slurry of water into the central compartments through openings described below. The porosity of upper sheet 178 and mat 172 should be sufficient such that the water in the slurry filters out of the central pockets 170 leaving the particulate matter behind. Geotextile fabrics sold by Phillips Fibers Corporation under the mark SUPAC are exemplary of acceptable materials. Cement, mortar or other such cementitious substances are most preferably injected into central pockets 170.

Figure 8:
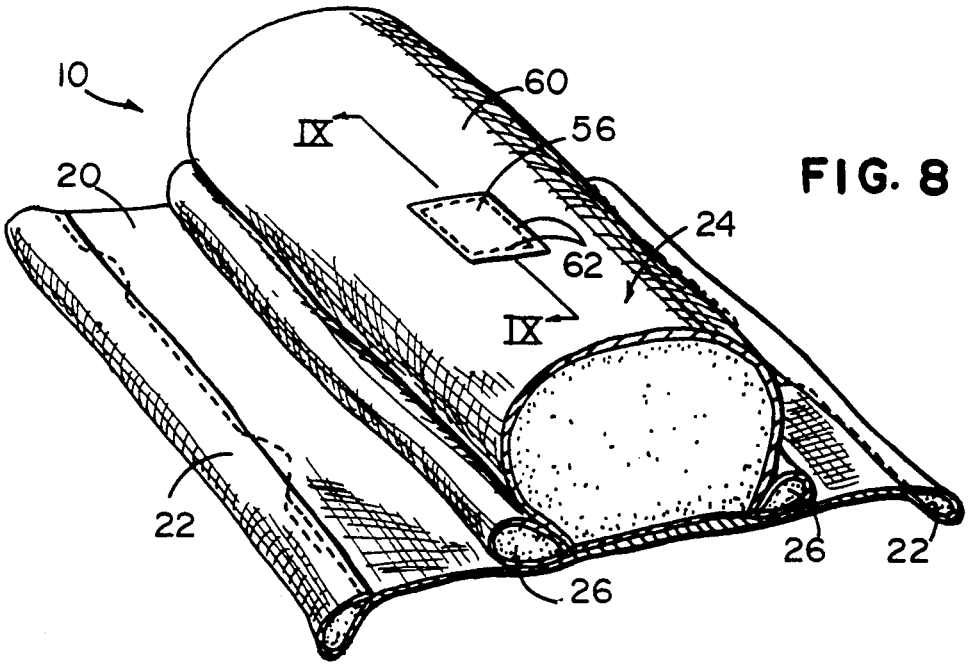
FIG. 8 is a fragmentary, perspective view of an erosion control system showing a fill inlet.

To inject concrete or sand into central pockets 170, a plurality of double-layered patch arrangements 177 (FIGS. 17 and 19) are spaced ten to twenty feet apart along the length of each central pocket 170. Each layered patch arrangement 170 is constructed identically to the layered patches 56 and 58 shown in FIGS. 8–10. Not all of the layered patch arrangements 177 need to be sliced and opened with offset slits for injection of slurry. Often, only one of the layered patches 177 needs to be opened because sand can be injected throughout the entire compartment. However, sometimes a large kink develops in the central compartment where the unit is laid over a sharp dropoff or other obstruction along the lake or ocean bottom. In such situations, layered patches on either side of the obstruction are sliced with offset slits and slurry is injected into the compartment through openings cut on either side of the obstruction. Similarly, the injection equipment may not be able to generate the pressure necessary to inject slurry throughout the entire central compartment from one sliced layered patch 177 if the compartment is particularly long. Therefore, slurry is injected into the compartment through several sliced layered patches 177.

Each central pocket 170 should extend twenty-four to twenty-eight inches above mat 172 when filled. This height has been found sufficient to perform the current and wave energy dissipation function described above.

Hydraulic pressure on the sand on each side of mat 172 generated by the waves forces sand underneath mat 172 and moves the structure upwardly. One advantage of having the central pockets sewn onto the mats is that the pockets cannot topple from the mats. It also eliminates guesswork in estimating how many tiers or levels of sandbags have to be placed on the mats because the structures will be raised naturally to the proper current-dissipating height from the original bottom as the bottom underneath the mat rises. After the structure rises to the proper depth, sand fills around and between a series of parallel structures (FIG. 17), eventually covering them.

Another advantage to the embodiment illustrated in FIGS. 16–19 is that each unit can be sewn beforehand and rolled or folded for shipment. On site, the unit can simply be unrolled as a complete integral unit and filled. The units may be filled with in situ underwater sand to avoid having to bring heavy trucks laden with sand or concrete on location.

The erosion control device shown in FIGS. 16–19 may be positioned along the shoreline either perpendicular (FIG. 17) or parallel to the shoreline, in the same fashion as the structures 10 described above are positioned. It should also be noted that having two parallel central compartments is not critical. In some cases, only one long compartment or more than two parallel central compartments can be used.

The fabrics used to make the bags, mats and central pockets of the erosion control devices described above are preferably coated with substances which protect the fabrics from ultraviolet and infrared light and mildew. Coatings having substituted enzophenones and titanium dioxide can protect the fabric from ultraviolet and infrared light. Mildew and bacteria can be inhibited by using triphenyltin monophenoxide in the coatings. Such coatings are known in the art, see for example Hepworth U.S. Pat. No. 3,957,098 entitled EROSION CONTROL BAG, issued on May 18, 1976.

A method of unrolling and positioning the erosion control devices of the present invention is shown in FIGS. 22–25. As indicated above, mat 20 without the central compartments or the mat structure with central compartments 170 can be rolled for shipment and unrolled at the installation site for accurate and easy placement. A mat structure 190 is rolled onto a tube 192 so that the openings of the peripheral pockets will be oriented upwardly when the mat structure is unrolled from tube 192.

Figure 22:
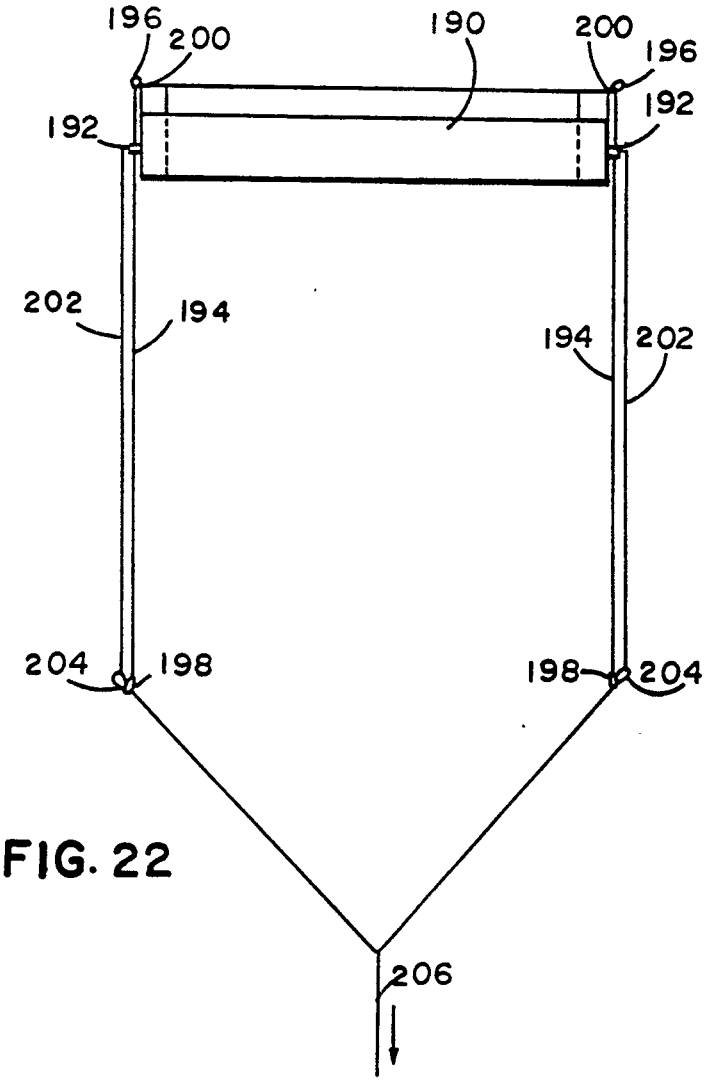
FIG. 22 is a plan view of a method of installing the erosion control devices of the present invention with one device shown rolled.
Figure 24:
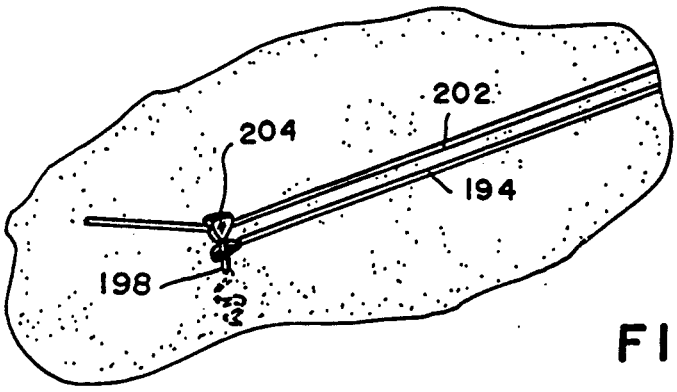
FIG. 24 is a detailed, perspective view of a pulley arrangement used to unroll the rolled erosion control device.
Figure 23:
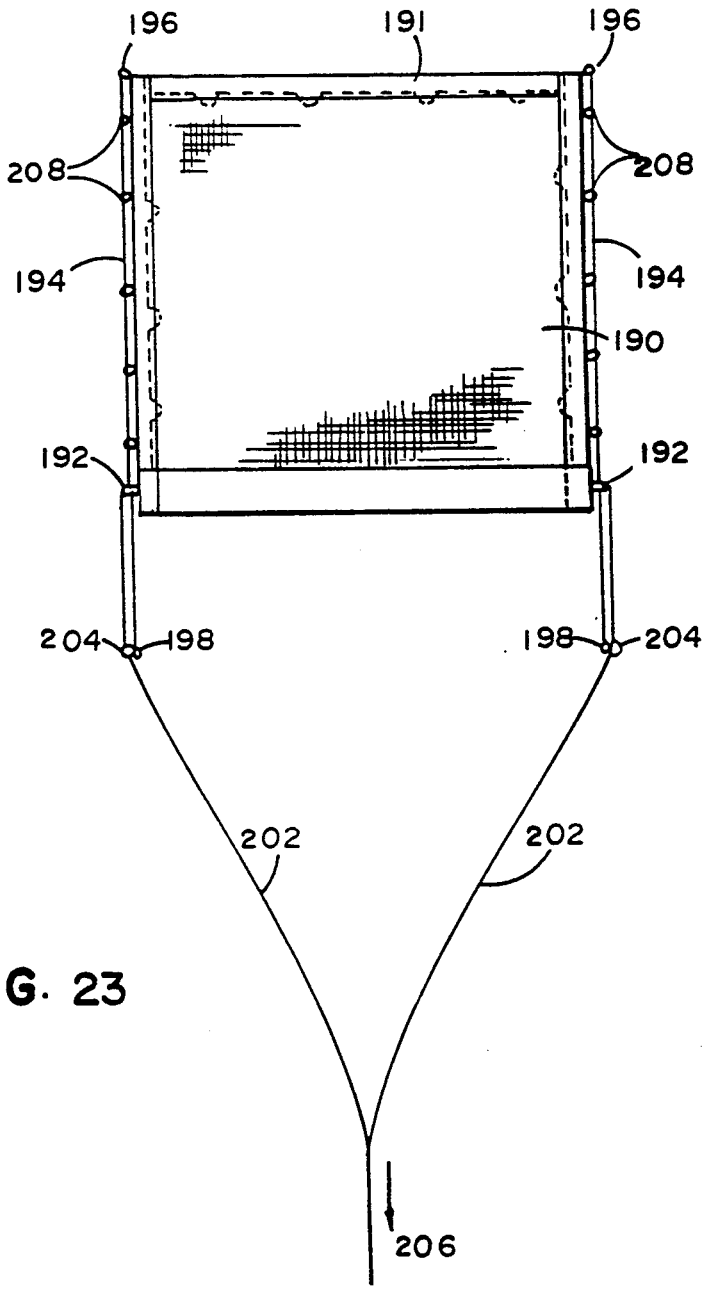
FIG. 23 is a plan view of a method of installing the erosion control devices of the present invention with one device shown partially unrolled.

Two guide cables 194 are positioned parallel to one another on either side of the area over which the mat structure is to lay. Guide cables 194 are positioned sufficiently far apart so that the rolled mat structure can be placed between them as shown in FIG. 22. The ends of each guide cable 194 are anchored securely to the ocean (lake) bottom by screw anchors 196 and 198 which screw into the bottom.

The rolled mat structure 190 is positioned between guide cables 194 near the first ends of guide cables 194 secured to screw anchors 196. The first two corners 200 of mat structure 190 are secured to screw anchors 196 or the first ends of cables 194 by means to be described. Then, a second cable 202 is secured to each end of tube 192 on which mat structure 190 is rolled. Each of the second cables is then laid next to one of guide cables 194.

A pulley 204 (FIGS. 22–24) is pivotally secured to each screw anchor 198. Second cables 202 are drawn through pulleys 198 and joined together beyond screw anchors 198 to a tow cable 206. Tow cable 206 is then pulled with a boat, a winch, or an underwater propulsion device so that second cables 202 are pulled through pulleys 204 and mat structure 190 is unrolled.

Figure 25:
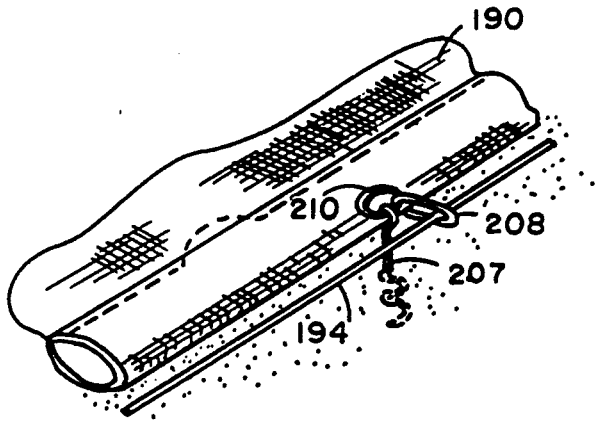
FIG. 25 is a detailed, perspective view of an edge of an unrolled erosion control device fastened to a temporary guide cable.

As mat structure 190 is unrolled, its edges are fastened to guide cables 194 by fasteners 108 (FIG. 15). Fasteners 208 are loops of wire, strapping material or the like which loop around cables 194 and are received by grommets 210 along the edges of mat structure 190 (FIG. 25). Grommets 210 are about ten to fifteen feet apart (FIG. 24) along the two elongated sides of the mat structure. Grommets 210 and fasteners 208 can be used to secure corners 200 to screw anchors 196 as well.

As the mat structure 190 is being unrolled, it must be anchored directly to the seabottom along its edges because screw anchors 196 and 198 and cables 194 cannot hold the mat down by themselves against strong currents. Screw anchors 196 and 198 will pull out if strong currents get underneath the mat structure. To prevent this, a screw anchor 207 (FIG. 25) is screwed into seabottom and connected to each grommet 210 along the sides of mat structure 190. With a plurality of screw anchorages 207 anchoring the edges of the mat and screw anchors 196 and 198 anchoring the corners, the mat will not lift under strong currents before the peripheral pockets fill or are filled with sand. After the peripheral pockets are filled, anchors 196, 198 and 210 are removed to allow the peripheral pockets to assume their downward orientation and anchor the mat structure to the seabottom.

If mat structure 190 is the type that has central compartments, they are then filled with sand. If some other elongated tubular stabilizer means are used, they are positioned on top of mat structure 190 and pumped full of cementitious material in the manner previously described.

The positioning method described above can be used no matter whether the devices are positioned parallel or perpendicular to shore. If perpendicular, screw anchors 196 are anchored and screwed into the beach above the waterline; screw anchors 198 are anchored into bottom 118 below the waterline. If parallel, all the screw anchors will be underwater.

It can be seen that the construction and installation of the beach restoration devices of the present invention is extremely straightforward. The basic devices, namely, the mats and elongated tubular stabilizers or compartments, are made of sewn fabric, which is very easy to manufacture and transport. The rolled mat assemblies are transported to the installation site and unrolled with very simple equipment and with the help of several divers. In the event concrete is not to be used, no heavy equipment is required if sand is available on site. The sand slurry is pumped into the peripheral pockets and elongated tubular compartments, the cross tubular elements and installation is complete.

After the mat structure is unrolled, cables 202 and tube 192 are removed. After the mat structure peripheral pockets 191 are filled, cables 202, screw anchors 196 and 198, and fasteners 208 are removed. The filled peripheral pockets are sufficiently heavy to hold the mat stretched out overlaying the bottom so that currents cannot move the mat before or during filling of the elongated central compartments.

While several embodiments of the invention have been disclosed and described, other modifications will be apparent to those of ordinary skill in the art. The embodiments described above are not intended to limit the scope of the invention which is defined by the claims which follow.

The embodiments of the invention in which an exclusive property or privilege is claimed are defined as follows.

1. A backshore sill beach and dune erosion control system comprising:

a supporting protective apron formed of weather and water resistant cloth, said apron including a flat base portion and an angularly sloped portion extending seaward of said base portion, a toe scour anchor tube connected to the seaward end of said apron sloped portion, said toe scour anchor tube formed by a loop secured in the end of the sloped portion of said supporting apron and filled with sand, said anchor tube loop being formed by doubling the apron sloped portion back over itself and sewn at specified contact areas providing unsewn sand filling points in the tube, and a plurality of longitudinal sand-filled geotextile containers placed upon said apron base portion each extending longitudinally shore parallel to the incoming surf, said sand-filled geotextile containers being specifically placed upon the beach in a pyramidal longitudinally extending shore parallel relation to an area being protected whereby wave action impacts upon relatively soft surfaces of said containers and is dissipated before normally impacting surfaces that would otherwise be eroded.

* * * * *